US005222566A

United States Patent [19]

Taylor et al.

[11] Patent Number: 5,222,566

[45] Date of Patent: Jun. 29, 1993

[54] ROTARY DRILL BITS AND METHODS OF DESIGNING SUCH DRILL BITS

[75] Inventors: Malcolm R. Taylor, Gloucester; Andrew Keohane, Gloucestershire, both of England

[73] Assignee: Camco Drilling Group Ltd., Stonehouse, England

[21] Appl. No.: 828,425

[22] Filed: Jan. 31, 1992

[30] Foreign Application Priority Data

Feb. 1, 1991 [GB] United Kingdom ..... 9102258

[51] Int. Cl.[5] ..... E21B 10/36

[52] U.S. Cl. ..... 175/431; 175/378

[58] Field of Search ..... 175/376, 378, 398, 413, 175/426, 431

[56] References Cited

U.S. PATENT DOCUMENTS 4,475,606 10/1984 Crow .
4,577,706 3/1986 Barr .
4,738,320 4/1988 Baroin .
4,942,933 7/1990 Barr .
5,033,560 7/1991 Sawyer et al. ..... 175/431

FOREIGN PATENT DOCUMENTS 2190120 11/1987 United Kingdom .
2246378 1/1992 United Kingdom .

*Primary Examiner*—William P. Neuder

[57] ABSTRACT

A rotary drill bit comprises a bit body having a shank for connection to a drill string, a plurality of cutter assemblies mounted on the bit body, and a passage in the bit body for supplying drilling fluid to the surface of the bit. Certain cutter assemblies on the bit body are adapted to exhibit a volume factor which is significantly greater than the volume factor of other cutter assemblies on the bit body, with increase of rate of penetration, and at least the majority of said cutter assemblies of higher volume factor are better adapted for cutting softer formations than at least the majority of said other cutter assemblies. The bit therefore tends to act as a "heavy set" drill bit at lower rates of penetration in hard formations, and as a "light set" drill bit at higher rates of penetration in softer formations, and therefore tends to drill each formation more efficiently.

5 Claims, 3 Drawing Sheets

Volume factor against radius of cutting
ds 34. cu2 at 5mm/rev

ROTARY DRILL BITS AND METHODS OF DESIGNING SUCH DRILL BITS

BACKGROUND OF THE INVENTION

The invention relates to rotary drill bits for drilling or coring holes in subsurface formations, and of the kind comprising a bit body having a shank for connection to a drill string, a plurality of cutter assemblies mounted on the bit body, and a passage in the bit body for supplying drilling fluid to the surface of the bit for cleaning and/or cooling the cutters. The invention also provides methods of designing such bits.

In a common form of such drill bits, each cutter assembly comprises an elongate stud which is received in a socket in the surface of the bit body, the stud having mounted at one end thereof a preform cutting element. The preform cutting element may be of the kind comprising a tablet, often circular or part-circular, having a thin hard cutting layer of polycrystalline diamond bonded to a thicker, less hard substrate, for example of cemented tungsten carbide.

In such a drill bit it is possible to calculate the volume of material removed from the formation by each cutter, per revolution, at any given rate of penetration. For example, computer systems are in use which allow such volumes to be calculated both in respect of existing manufactured drill bits as well as theoretical designs for such bits. The volume of material removed by each cutter is known as the "volume factor" and is subject to a number of variables. For example the volume factor of a particular cutting element will vary according to its axial or radial position relative to other cutting elements. Thus, if a cutting element is radially located on the bit so that its path of movement partly overlaps the path of movement of a preceding cutting element, as the bit rotates, it will remove a lesser volume of material than would be the case if it were radially positioned so that such overlapping did not occur, or occurred to a lesser extend, since the leading cutting element will already have removed some material from the path swept by the following cutting element.

Similarly, a cutting element which is axially positioned so that it projects further than another similar cutter from the surface of the bit body (or corresponding surface of rotation) may remove more material per revolution than said cutter.

Graphs may be plotted showing the volume factor of each cutting element against the radius of cutting, i.e. the distance of the centroid of the cutting from the central axis of the bit, (the "cutting" being the formation material removed by the cutting element). Such graphs may be comparatively smooth or may be "spiky", the presence of spikes indicating one or more cutters which are removing a greater volume of material per revolution than cutting elements at slightly lesser and slightly greater radii.

The actual volume of material removed by each cutter increases with increased rate of penetration of the drill bit and different graphs can therefore be drawn for different rates of penetration. Generally speaking, the "spikiness" of a graph will increase with increase in the rate of penetration.

Hitherto, it has been considered desirable for such graphs to be as smooth as possible so that each cutting element removes a similar volume of material to cutting elements at slightly lesser and slightly greater radii. (It will be appreciated that such cutting elements will not necessarily be adjacent one another on the actual bit body and may well be angularly displaced from one another by a considerable distance). It has been believed that a drill bit exhibiting a spiky volume factor graph is likely to suffer uneven wear, and thus premature failure, as a result of some cutting elements removing a greater volume of material per revolution and thus doing a greater share of the work.

SUMMARY OF THE INVENTION

The present invention is based on the realisation that, contrary to such teaching, there may be advantage in deliberately designing a bit so that certain of the cutters, or certain regions of the bit, effect a disproportionately large amount of removal of material from the formation. According to the invention, also, the advantages may be increased if such cutter assemblies are designed to have characteristics which render them particularly suitable for cutting the formation under conditions where high rates of penetration are likely to occur.

For example, it is commonly accepted that bits suitable for drilling hard formations should be "heavy set", i.e. that the bit body should carry a large number of distributed cutter assemblies, each effecting a comparatively small amount of removal of material from the formation during each revolution. In softer formations, however, it is often a successful strategy to employ a drill bit which is "light set", i.e. has comparatively fewer but larger cutter assemblies, each of which effects removal of a greater volume of formation material than is the case in a heavy set bit.

Rates of penetration are generally higher in softer formations and, as explained above, there is a tendency, as the rate of penetration increases, for some cutters to effect an increasing proportion of material removal. According to the present invention this effect is enhanced by so designing a comparatively "heavy set" drill bit that at high rates of penetration, which will normally occur in softer formations, a minority of cutter assemblies will effect a disproportionately large share of the material removal. The bit therefore acts, in effect, as a light set bit and drills the softer formations more efficiently.

The bit is also so designed that those cutter assemblies which are effecting the majority of the material removal at high rates of penetration are of such a kind as to be particularly suitable for removing material from soft formations. For example, they may be larger and/or more efficiently cleaned than other cutter assemblies on the bit which only effect a significant amount of material removal at lower penetration rates in harder formations.

According to the invention therefore there is provided a rotary drill bit of the kind first referred to, wherein certain cutter assemblies on the bit body are adapted to exhibit a volume factor (as hereinbefore defined) which is significantly greater than the volume factor of other cutter assemblies on the bit body, with increase in rate of penetration, and wherein at least the majority of said certain cutter assemblies are better adapted for cutting softer formations than at least the majority of said other cutter assemblies.

The better adaptation for cutting softer formations may be achieved by said higher volume factor assemblies including cutting elements of larger area than the cutting elements of said other cutter assemblies of lower volume factor. Alternatively or additionally said higher volume factor cutter assemblies may be located in such relation to nozzles for delivering drilling fluid to the face of the bit as to be more efficiently cleaned than said lower volume factor cutter assemblies. Thus, for purposes of this specification, when it is said that "a cutter is adapted for cutting softer formations" such adaptation may include features intrinsic to the cutter per se and/or features pertaining to the disposition of the cutter relative to other parts of the bit.

The higher volume factor cutter assemblies may be disposed in different regions of the bit body from said lower volume factor cutter assemblies. For example, in the case where the cutter assemblies are mounted on a plurality of blades extending generally outwardly away from the central axis of rotation of the bit body, there may be provided blades which carry cutter assemblies which are all substantially of higher volume factor and other blades which carry cutter assemblies which are substantially all of lower volume factor.

The invention also provides a method of designing a rotary drill bit of the kind first referred to, said method comprising correlating the volume factors of cutter assemblies with the cutting characteristics of said assemblies, whereby cutter assemblies of higher volume factor are better adapted for cutting softer formations than cutter assemblies of lower volume factor.

The method may comprise designing a bit so that some cutter assemblies are better adapted for cutting softer formations than others and then adjusting the locations and/or orientations of the cutter assemblies so that, overall, those cutter assemblies which are better adapted for cutting softer formations exhibit a greater volume factor than cutter assemblies which are less well adapted for cutting softer formations.

Alternatively, the method may comprise designing a drill bit so that certain cutter assemblies have a significantly higher volume factor than other cutter assemblies and then adjusting the design of said high volume factor cutter assemblies to render them better adapted for cutting softer formations.

The method according to the invention may also be applied to the modification of existing designs of drill bit. Thus in an existing design the method may comprise the steps of identifying regions of the bit where most efficient cleaning of cutter assemblies takes place and then adjusting the positions of cutter assemblies on the bit body so that cutter assemblies in such regions have a significantly higher volume factor than cutter assemblies in other regions of the drill bit. Alternatively or additionally, in an existing bit design incorporating cutting elements of various sizes, the method may comprise adjusting the positions of cutter assemblies so that those cutter assemblies having larger cutting elements have a higher volume factor than cutter assemblies having smaller cutting elements.

DETAILED DESCRIPTION OF THE PREFERRED EMBODIMENTS

Figure 1:
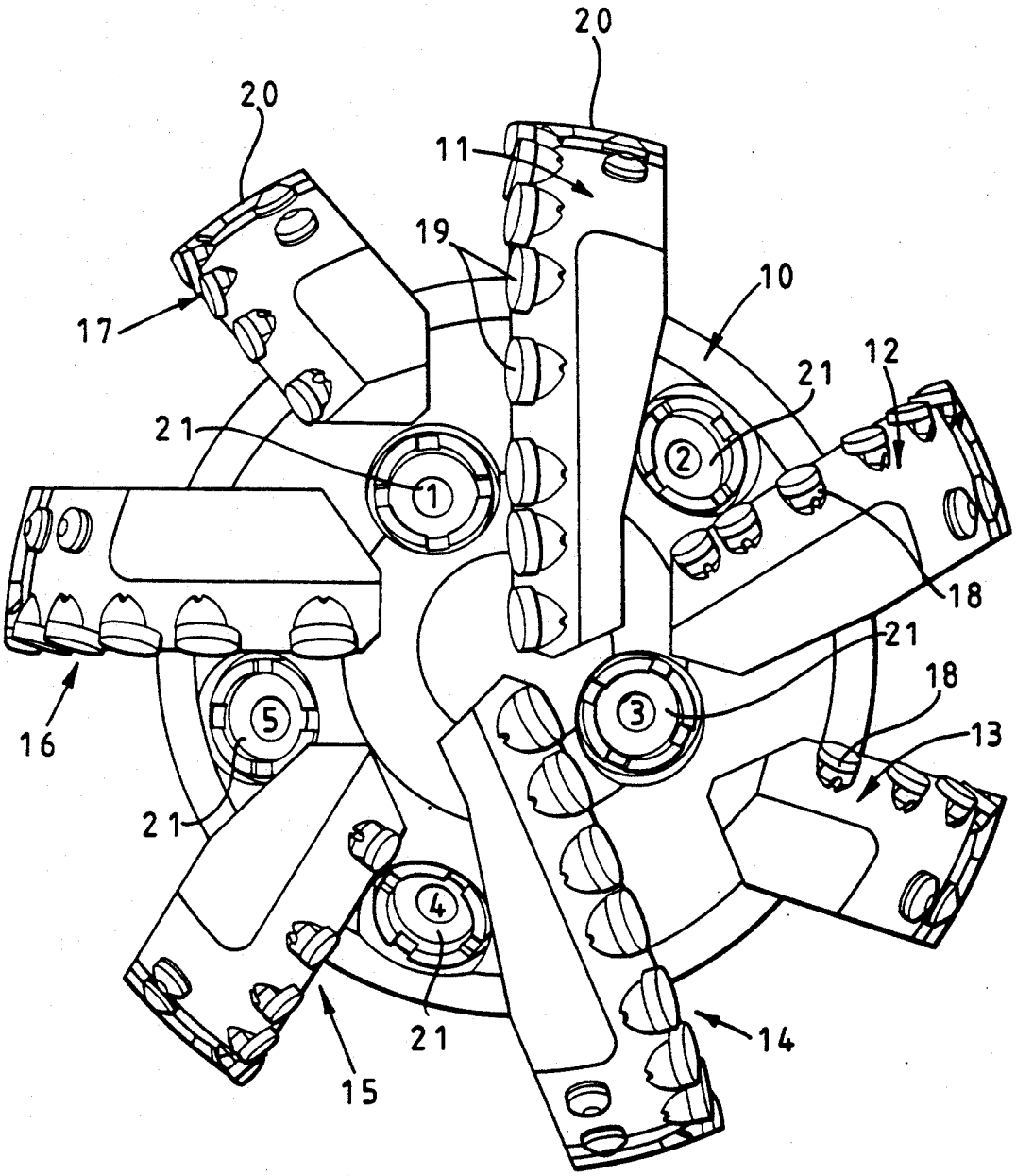
FIG. 1 is an elevation of a drill bit according to the invention.

Referring to FIG. 1, there is shown an end view of a full bore drill bit of the kind to which the present invention may be applied, i.e. a drag bit, and which has in fact been designed according to the invention.

The bit body 10 is typically machined from steel and has a threaded shank (not shown) at one end for connection to the drill string.

The operative end face of the bit body is formed with seven blades 11–17 radiating outwardly from the central area of the bit, the blades carrying cutter assemblies 18 or 19 spaced apart along the length thereof.

The bit gauge section includes kickers 20 which contact the walls of the bore hole in use to stabilise the bit in the bore hole. A central passage (not shown) in the bit body and shank delivers drilling fluid through nozzles 21 mounted in the bit body, in known manner, to clean and cool the cutter assemblies.

Each cutter assembly 18 or 19 comprises a preform cutting element 30 or 31, respectively, mounted on a carrier 32 or 33, respectively, in the form of a stud which is secured in a socket 34 or 35, respectively, in the bit body. Each cutting element comprises a circular tablet having a front facing layer of polycrystalline diamond, providing the front cutting face of the element, bonded to a substrate of cemented tungsten carbide, the substrate being in turn bonded to the carrier.

It will be appreciated that this is only one example of many possible variations of the type of bit to which the present invention is applicable. The present invention does not relate to the specific configuration of the bit but to general concepts which may be advantageously employed in the design of such a bit.

It will be seen that the cutting elements of the cutter assemblies 18 on the blades 12, 13, 15 and 17 are smaller in diameter than the cutting elements of the cutter assemblies on the blades 11, 14 and 16. The smaller cutting elements may, for example be 13 mm in diameter and the larger cutting elements 19 mm in diameter.

As previously explained, for a given design of bit, with the cutter assemblies located in given positions on the blades, it is possible to calculate the volume of formation material removed by each cutter assembly at any given rate of penetration. Such bits are sometimes designed making use of computer CADCAM systems and the programs of such systems may incorporate algorithms for performing the necessary calculations for any given design, and producing a graph in which the volume factor of each cutter assembly is plotted against the radius of cutting for a given rate of penetration.

Figure 2:
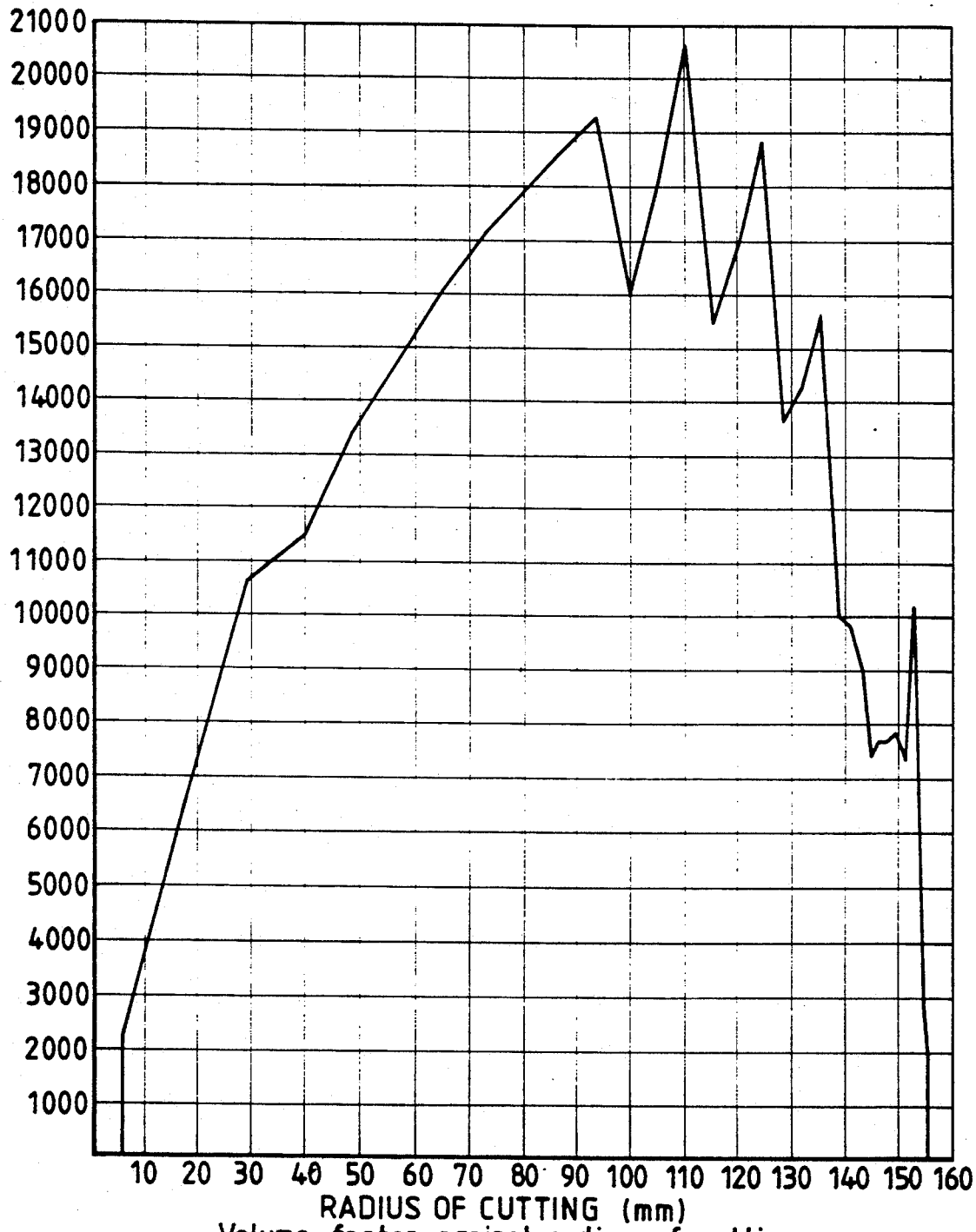
FIG 2 (Prior Art)
FIG. 2 is a graph of volume factor against radius of cutting for a typical prior art drill bit.

FIG. 2 shows a typical graph of volume factor against radius of cutting for a prior art drill bit at a rate of penetration of 5 mm per revolution. It will be seen that although the graph is comparatively smooth up to a radius of cutting of about 90 mm, outwardly thereof the graph becomes "spiky" indicating that over a relatively short, range of cutting radius some cutters are doing more work than others, i.e. are removing a greater volume of formation material during each revolution. In a prior art drill bit the cutters which are doing most work will be random and will not, in any predetermined way, differ in their operational characteristics from cutters which are doing less work. Also, the difference in volume factor between cutters within a small range of cutting radius will not normally be sufficiently significant to affect the overall effectiveness of the drill bit, one way or the other, at the particular rate of penetration. As previously explained, it has hitherto been considered desirable, by appropriate positioning of the cutters in relation to one another, to remove these spikes from the graph and to render the graph as smooth as possible.

According to the present invention, however, the cutters are deliberately so positioned relatively to one another that very significant spikes appear in the graph at higher rates of penetration. At the same time the operating characteristics of the cutters represented by such spikes are so selected as to render those cutters particularly suitable for effective drilling of softer formations.

Figure 3:
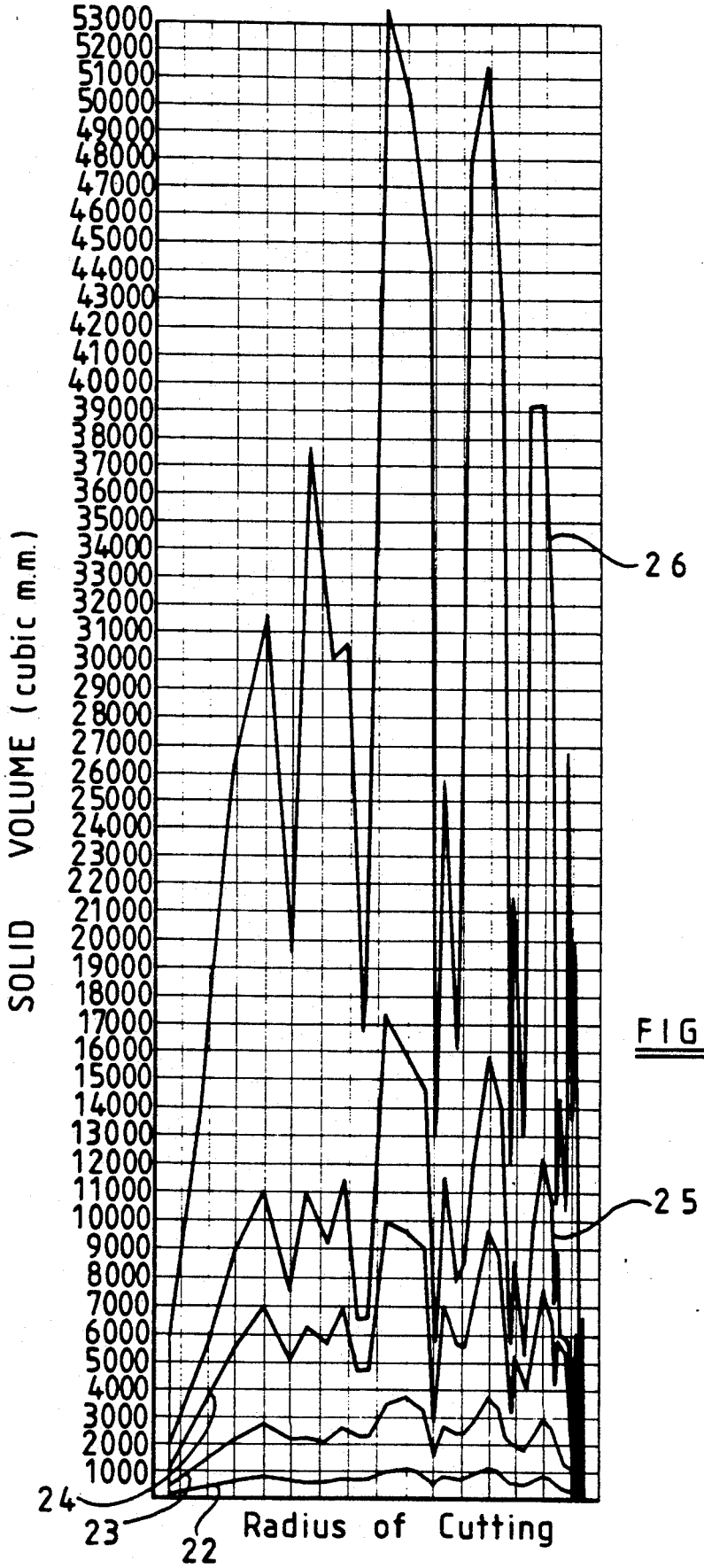
FIG. 3 is a graph of volume factor against radius of cutting, at different rates of penetration, for the drill bit of FIG. 1.

FIG. 3 shows a graph of volume factor against radius of cutting for the drill bit of FIG. 1.

FIG. 3 shows five curves for different rates of penetration as follows:

| | |
|---|---|
| 22 = | .3 mm per rev |
| 23 = | 1.0 mm per rev |
| 24 = | 2.5 mm per rev |
| 25 = | 4.0 mm per rev |
| 26 = | 12.0 mm per rev |

It will be seen that at a minimum rate of penetration of 0.3 mm per rev, the curve 22 is comparatively smooth, indicating that the removal of formation material is reasonably evenly distributed across the radius of cutting. However, as the rate of penetration increases the curve becomes increasingly spiky, indicating that fewer and fewer of the cutters are effecting more and more of the material removal. At the higher rates of penetration, each spike represents a cutter or small group of cutters which is performing a disporportionely high portion of material removal.

The bit of FIG. 1 is so designed that these cutters which are removing most of the material are the larger diameter cutters 19 on the blades 11, 14 and 16. This means that as the rate of penetration increases the smaller cutters 18 on the blades 12, 13, 15 and 17 perform less and less material removal in relation to the larger cutters 19 on the other blades, so that in soft formations, where the highest rates of penetration occur, substantially all the cutting is being effected by the larger cutters 19. Thus, the drill bit has the effect of automatically changing from a "heavy set" drill bit when drilling hard formations at a low rate of penetration, to a "light set" drill bit when drilling softer formations at a higher rate of penetration.

The larger cutters 19, as is well known, are better suited to drilling through softer formations. It is also well known that in the design and location of nozzles for delivering drilling fluid to the cutters, any arrangement will inevitably result in some cutters, being more efficiently cleaned than others. In accordance with the invention, the cutters which will be doing most of the work at the higher rates of penetration are preferably so disposed in relation to the nozzles 21 that they are in the regions of the bit which are most efficiently cleaned. Such efficient cleaning becomes increasingly important with softer formations which have a tendency to clog and ball on the bit surface if not efficiently cleaned away.

We claim:

1. A rotary drill bit for drilling holes in subsurface formations, comprising a bit body having a shank for connection to a drill string, a plurality of cutter assemblies mounted on the bit body, and a passage in the bit body for supplying drilling fluid to the surface of the bit for cleaning and cooling the cutters, wherein certain cutter assemblies on the bit body are higher volume factor cutter assemblies adapted to exhibit a volume factor which is significantly greater than the volume factor of other cutter assemblies on the bit body, with increase in rate of penetration, and wherein at least the majority of said higher volume factor cutter assemblies are better adapted for cutting softer formations that at least the majority of said other cutter assemblies.

2. A rotary drill bit according to claim 1, wherein said better adaptation for cutting softer formations is achieved by said higher volume factor assemblies including cutting elements of larger area than the cutting elements of said other cutter assemblies of lower volume factor.

3. A rotary drill bit according to claim 1, wherein said higher volume factor cutter assemblies are located in such relation to nozzles for delivering drilling fluid to the face of the bit as to be more efficiently cleaned than said lower volume factor cutter assemblies.

4. A rotary drill bit according to claim 1, wherein said higher volume factor cutter assemblies are disposed in different regions of the bit body from said lower volume factor cutter assemblies.

5. A rotary drill bit for drilling holes in subsurface formations, comprising: a bit body having a shank for connection to a drill string, a plurality of cutter assemblies mounted on the bit body, and a passage in the bit body for supplying drilling fluid to the surface of the bit for cleaning and cooling the cutters, wherein certain cutter assemblies on the bit body are higher volume factor cutter assemblies adapted to exhibit a volume factor which is significantly greater than the volume factor of other cutter assemblies on the bit body, with increase in rate of penetration, wherein the cutter assemblies are mounted on a plurality of blades extending generally outwardly from the central axis of rotation of the bit body, there being provided blades which carry cutter assemblies which are all substantially of higher volume factor and other blades which carry cutter assemblies which are substantially all of lower volume factor, and wherein at least the majority of said higher volume factor cutter assemblies are better adapted for cutting softer formations than at least the majority of said other cutter assemblies.

* * * * *